US010502028B2

(12) United States Patent
Durst

(10) Patent No.: US 10,502,028 B2
(45) Date of Patent: Dec. 10, 2019

(54) EXPANDABLE REENTRY COMPLETION DEVICE

(71) Applicant: Halliburton Energy Services, Inc., Houston, TX (US)

(72) Inventor: Douglas Glenn Durst, Jersey Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 153 days.

(21) Appl. No.: 15/537,388

(22) PCT Filed: Sep. 19, 2016

(86) PCT No.: PCT/US2016/052476
§ 371 (c)(1),
(2) Date: Jun. 16, 2017

(87) PCT Pub. No.: WO2018/052452
PCT Pub. Date: Mar. 22, 2018

(65) Prior Publication Data

US 2019/0010786 A1 Jan. 10, 2019

(51) Int. Cl.

| | |
|---|---|
| ***E21B 41/00*** | (2006.01) |
| ***E21B 43/10*** | (2006.01) |
| ***E21B 33/12*** | (2006.01) |
| ***E21B 7/06*** | (2006.01) |
| ***E21B 29/00*** | (2006.01) |
| ***E21B 43/26*** | (2006.01) |

(52) U.S. Cl.
CPC ..... *E21B 41/0042* (2013.01); *E21B 7/061* (2013.01); *E21B 29/00* (2013.01); *E21B 33/12* (2013.01); *E21B 43/106* (2013.01); *E21B 43/26* (2013.01)

(58) Field of Classification Search
CPC combination set(s) only.
See application file for complete search history.

(56) References Cited

U.S. PATENT DOCUMENTS 5,353,876 A 10/1994 Curington et al.
5,564,503 A 10/1996 Longbottom et al.
(Continued)

OTHER PUBLICATIONS

Schlumberger Oilfield Glossary, polished joint, 2013 (Year: 2013).*
(Continued)

*Primary Examiner* — Wei Wang
(74) *Attorney, Agent, or Firm* — Scott Richardson; C. Tumey Law Group PLLC

(57) ABSTRACT

A method includes severing a liner positioned in a first wellbore at least partially lined with casing and thereby providing a severed end, conveying a mid-completion assembly into the first wellbore and receiving the severed end within a tail pipe assembly of the mid-completion assembly, wherein a smallest inner diameter of the mid-completion assembly is greater than or equal to a smallest inner diameter of the liner and thereby permits tools sized for operations in the liner to pass through the mid-completion assembly, actuating an expandable device of the mid-completion assembly to sealingly engage an inner surface of the casing uphole from the severed end, and drilling a second wellbore extending from the first wellbore.

18 Claims, 11 Drawing Sheets

(56) References Cited

U.S. PATENT DOCUMENTS 5,697,445 A 12/1997 Graham
5,715,891 A * 2/1998 Graham ..... E21B 7/061 166/117.6
5,730,224 A 3/1998 Williamson et al.
5,735,350 A 4/1998 Longbottom et al.
5,964,287 A 10/1999 Brooks
5,975,208 A 11/1999 Brooks
5,992,524 A 11/1999 Graham
5,992,525 A 11/1999 Williamson et al.
6,009,949 A 1/2000 Gano et al.
6,035,937 A 3/2000 Gano et al.
6,053,254 A 4/2000 Gano
6,062,306 A 5/2000 Gano et al.
6,065,543 A 5/2000 Gano et al.
6,079,494 A 6/2000 Longbottom et al.
6,092,593 A 7/2000 Williamson et al.
6,092,602 A 7/2000 Gano
6,119,771 A 9/2000 Gano et al.
6,158,514 A 12/2000 Gano et al.
6,209,648 B1 4/2001 Ohmer et al.
6,244,340 B1 6/2001 McGlothen et al.
6,374,918 B2 * 4/2002 Roberts ..... E21B 7/061 166/191
6,439,312 B1 8/2002 Hess et al.
6,668,932 B2 12/2003 Hess et al.
6,679,329 B2 1/2004 Murray et al.
6,712,148 B2 * 3/2004 Fipke ..... E21B 41/0042 166/381
6,732,802 B2 5/2004 Smith
6,749,026 B2 * 6/2004 Smith ..... E21B 17/08 166/313
6,789,628 B2 9/2004 Hess et al.
6,830,106 B2 12/2004 Cavender
6,935,428 B2 8/2005 McGlothen et al.
7,584,795 B2 9/2009 Hepburn et al.
7,699,112 B2 4/2010 Galloway
8,794,328 B2 8/2014 Benson et al.
9,175,560 B2 11/2015 Algeroy et al.
2003/0037930 A1 * 2/2003 Coon ..... E21B 7/061 166/380
2005/0115713 A1 6/2005 Restarick et al.
2014/0102710 A1 4/2014 Benson et al.
2014/0102716 A1 4/2014 Benson et al.

OTHER PUBLICATIONS

International Search Report and Written Opinion for PCT/US2016/052476 dated May 31, 2017.

* cited by examiner

EXPANDABLE REENTRY COMPLETION DEVICE

BACKGROUND

Many times, a well that must be hydraulically fractured to be economic will experience a production decline that will make attaining the well's estimated ultimate recovery (EUR) difficult. Rather than drilling a new well, it may be economical to reenter the existing wellbore to access other portions or layers of the formation by drilling one or more new lateral wellbores off the existing wellbore. Additionally, in some cases, it may also be needed to re-stimulate the existing wellbore.

Generally, in order create a new lateral wellbore, an exit or window is cut into the liner of the existing (or parent) wellbore at a location where the lateral is to be drilled. Wellbore equipment is positioned at the location to drill the lateral wellbore that extends from the existing wellbore. Downhole equipment can then be extended into the lateral wellbore to complete the lateral wellbore as desired.

To re-access the parent wellbore for performing re-stimulation or other desired wellbore operations therein, the wellbore equipment used to form and complete the lateral wellbore is retrieved to the Earth's surface in a first downhole trip. In a second downhole trip, wellbore tools and other equipment are conveyed into the parent wellbore for performing the desired wellbore operations therein.

Accessing the parent wellbore after a lateral wellbore has been drilled can be trip intensive; i.e., meaning that it can require several downhole trips into the well. Reducing the number of trips into the well can save a significant amount of time and expense in wellbore operations.

BRIEF DESCRIPTION OF THE DRAWINGS

The following figures are included to illustrate certain aspects of the examples, and should not be viewed as exclusive examples. The subject matter disclosed is capable of considerable modifications, alterations, combinations, and equivalents in form and function, as will occur to those skilled in the art and having the benefit of this disclosure.

DETAILED DESCRIPTION

The present disclosure generally relates to multilateral wellbore operations and, more particularly, to reducing the number of trips required to drill and complete a lateral wellbore and maintaining a large internal diameter access that enables a well operator to re-enter a parent wellbore. A well whose production has declined over time may be reentered to perform re-stimulation operations. Alternatively, or additionally, one or more new lateral wellbores may be drilled from an existing wellbore (also referred to as a main or parent wellbore). Re-stimulating an existing wellbore and/or drilling a new lateral wellbore from the existing wellbore are cost effective measures for increasing production of formation fluids and thereby increasing the productive life of the well.

Examples disclosed herein are directed to a mid-completion assembly that is sized and otherwise configured such that existing wellbore equipment and/or wellbore equipment that was previously used for operations in the existing wellbore may still be able to access the existing wellbore without having to retrieve the mid-completion assembly to the earth's surface. As a result, new wellbore equipment is not required to bypass the mid-completion assembly to access lower portions of a wellbore, which equates to cost savings.

For the purposes of discussion herein, it should be noted that a lateral wellbore may be drilled in the same formation as an existing wellbore, or the lateral wellbore may be drilled in a different layer of the same formation, or otherwise into a different subterranean formation altogether. It should also be noted that examples described herein are equally applicable to maintaining access to an existing lateral wellbore when drilling one or more "branches" extending from the existing lateral wellbore. While examples herein are described with respect to horizontal wells, these are not limited thereto and are equally applicable to wells having other directional configurations including vertical wells, slanted wells, multilateral wells, combinations thereof, and the like.

In the description below, similar numbers used in any of FIGS. 1-6B refer to common elements or components that may not be described more than once.

Figure 1:
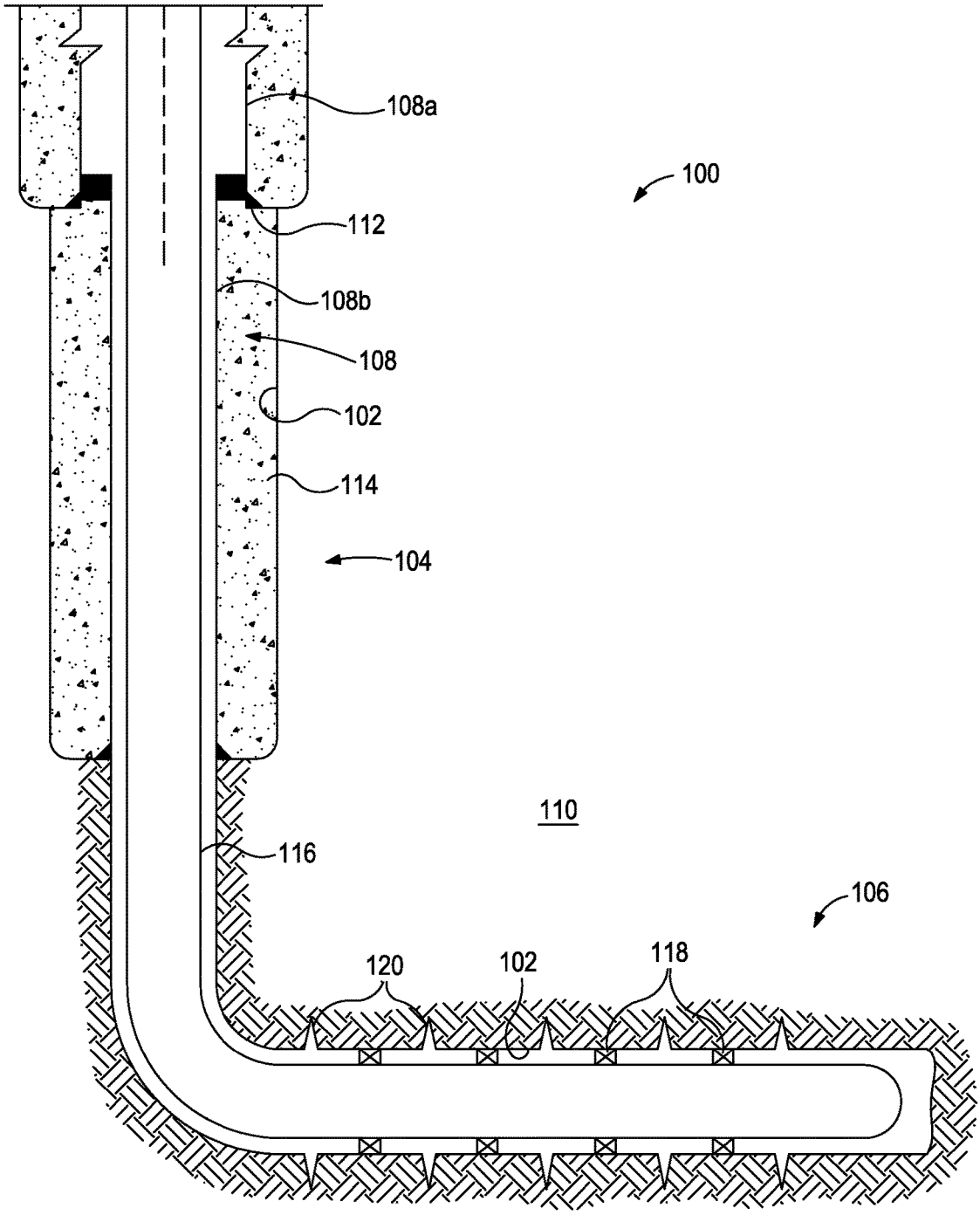
FIG. 1 illustrates is a well system that may employ the principles of the present disclosure.

Referring to FIG. 1, illustrated is an exemplary well system 100 that may employ the principles of the present disclosure. For the purposes of discussion herein, it is assumed that the well system 100 is an existing horizontal well system whose production has declined over time. As depicted, the well system 100 includes a main wellbore 102 having a substantially vertical section 104 that extends to a substantially horizontal section 106. The main wellbore 102 may be drilled through various subterranean formations, including formation 110, which may comprise a hydrocarbon-bearing formation. Following drilling operations, the main wellbore 102 may be completed by lining all or part of the main wellbore 102 with casing 108, shown as a first string of casing 108*a* and a second string of casing 108*b* that extends from the first string of casing 108*a*. The first string of casing 108*a* may extend from a surface location (i.e., where a drilling rig and related drilling equipment are located) or may alternatively extend from an intermediate point between the surface location and the formation 110.

The second string of casing 108*b* may be coupled to and otherwise "hung off" the first string of casing 108*a* at a liner hanger 112.

For the purposes of discussion herein, the first and second strings of casing 108*a,b* will be jointly referred to as the casing 108. All or a portion of the casing 108 may be secured within the main wellbore 102 with cement 114, which may be injected between the casing 108 and the inner wall of the main wellbore 102. The casing 108 and the cement 114 provide radial support to the main wellbore 102 and cooperatively seal against unwanted communication of fluids between the main wellbore 102 and the surrounding formation 110. In examples, portions of the main wellbore 102 may not be lined with the casing 108 and may thus be referred to as "open hole" portions of the main wellbore 102

A liner 116 may be positioned within the main wellbore 102 and extend from the surface location (not shown) to the horizontal section 106 or may alternatively extend from an intermediate location between the surface location and the formation 110. As used herein, the liner 116 may refer to any tubular or series of pipes coupled end to end that is conveyed into the main wellbore 102 for producing formation fluids from the main wellbore 102 and/or for performing wellbore operations in the main wellbore 102. The liner 116 may comprise, for example, production tubing, coiled tubing, a frac string, a long string, or any other pipe or liner that provides a fluid conduit for formation fluids (oil, gas, water, etc.) to be conveyed to the surface location for collection.

As illustrated, the horizontal section 106 of the main wellbore 102 has been hydraulically fractured ("fracked") (e.g., plug-and-perf operations, dissolvable plug-and-perf operations, continuous stimulation operations, and the like, and any combination thereof) to form a plurality of fractures 120 used to extract the formation fluids from the subterranean formation 110. Packers 118 arranged at desired intervals in the horizontal section 106 divide the formation 110 into multiple production zones and isolate adjacent production zones from each other. Although not expressly illustrated, each production zone may include a sliding sleeve positioned within the liner 116 and axially movable between closed and open positions to occlude or expose one or more flow ports defined through the liner 116. The liner 116 provides a conduit for the produced fluids extracted from the formation 110 to travel to the surface. Alternatively, the liner 116 may provide a conduit to pump fracking fluids downhole to stimulate the subterranean formation 110.

Although the fractures 120 are shown as being formed in the horizontal section 106 of the main wellbore 102, the fractures 120 may alternatively be formed in the vertical section 104, and in wells having other directional configurations including vertical wells, slanted wells, multilateral wells, combinations thereof, and the like. The use of directional terms such as above, below, upper, lower, upward, downward, left, right, uphole, downhole and the like are used in relation to the illustrative examples as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
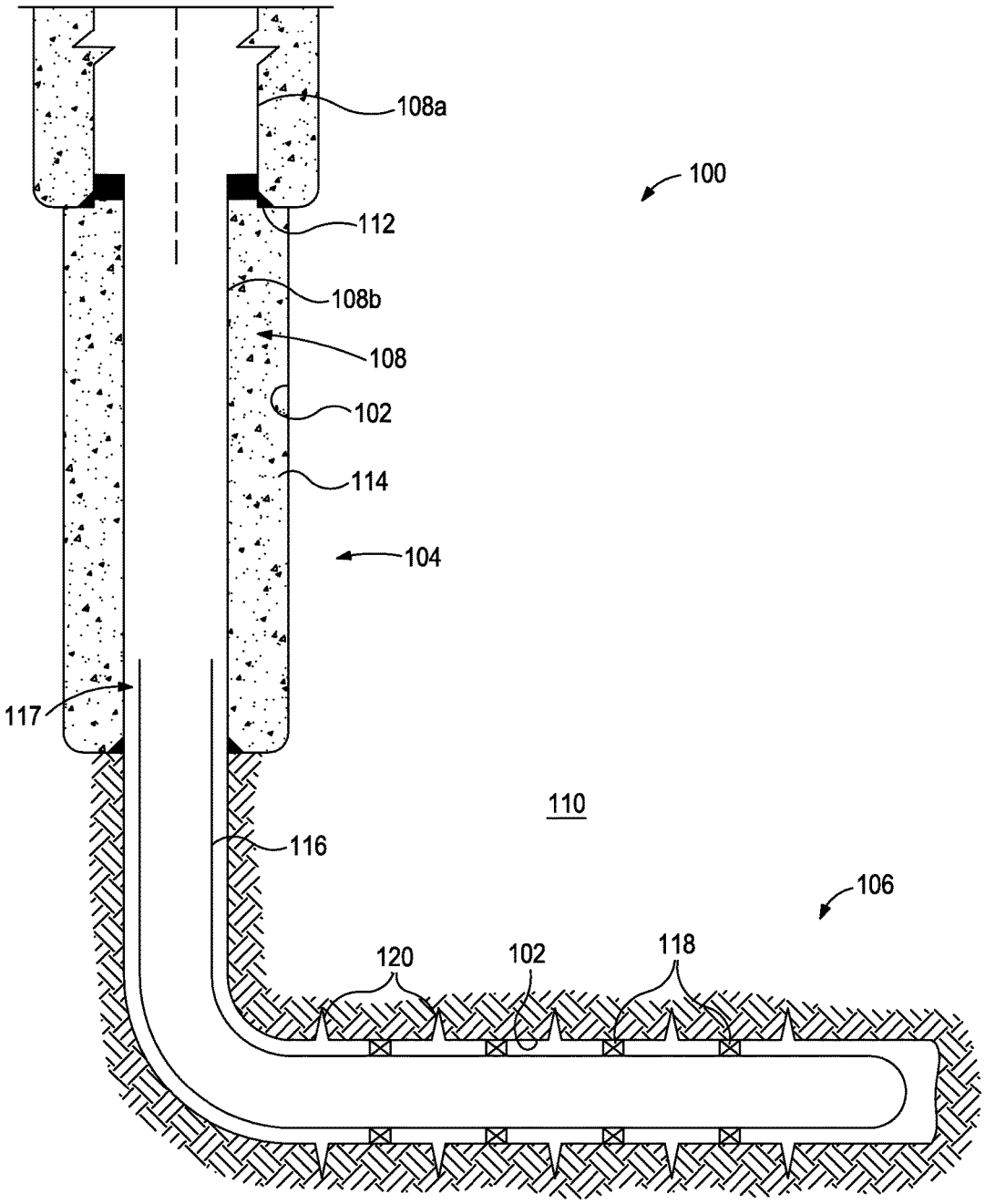
FIG. 2 illustrates the liner of FIG. 1 severed at or around a desired location in the wellbore of FIG. 1.

At some point in the lifespan of the main wellbore 102, it may be desired to drill a lateral wellbore that extends from the main wellbore 102. To accomplish this, as illustrated in FIG. 2, the liner 116 may be cut or severed at or around the location where the lateral wellbore is desired to be drilled. The uphole portion of the liner 116 is then removed from the main wellbore 102 and retrieved to the surface. Although FIG. 2 illustrates the liner 116 being cut in the vertical section 104 of the main wellbore 102, the liner 116 may alternatively be cut in the horizontal section 106 or any other location in the main wellbore 102, without departing from the scope of the disclosure.

A variety of cutting tools may be used to cut the liner 116 including, but not limited to, chemical cutters, jet cutters, radial cutting torches, severing tools, electrical arc tools, mechanical cutters, hydraulic cutters, pressure cutters, explosive cutters, abrasive cutters, and the like. Typically, the liner 116 may be cut between adjacent pipe joints; however, in examples, the liner 116 can be cut at any desired location along the liner 116. The cutting tools may be deployed in the main wellbore 102 using any desired conveyance including, but not limited to, tubing, coiled tubing, wireline, slickline, electric line, etc. Some of the cutting tools may include blades or cutters that extend radially outward to cut the liner 116 or may spray the liner 116 with chemicals (corrosive or abrasive materials) that "eat away" the material of the liner 116. Some other cutting tools may bombard the liner 116 with high-energy waves and/or use explosives to severe the liner 116. After the liner 116 is cut, the cut or exposed end 117 of the liner 116 may be machined, polished and/or shaped in preparation for receiving and installing one or more downhole tools, such as a sealing device or the like.

Figure 3A:
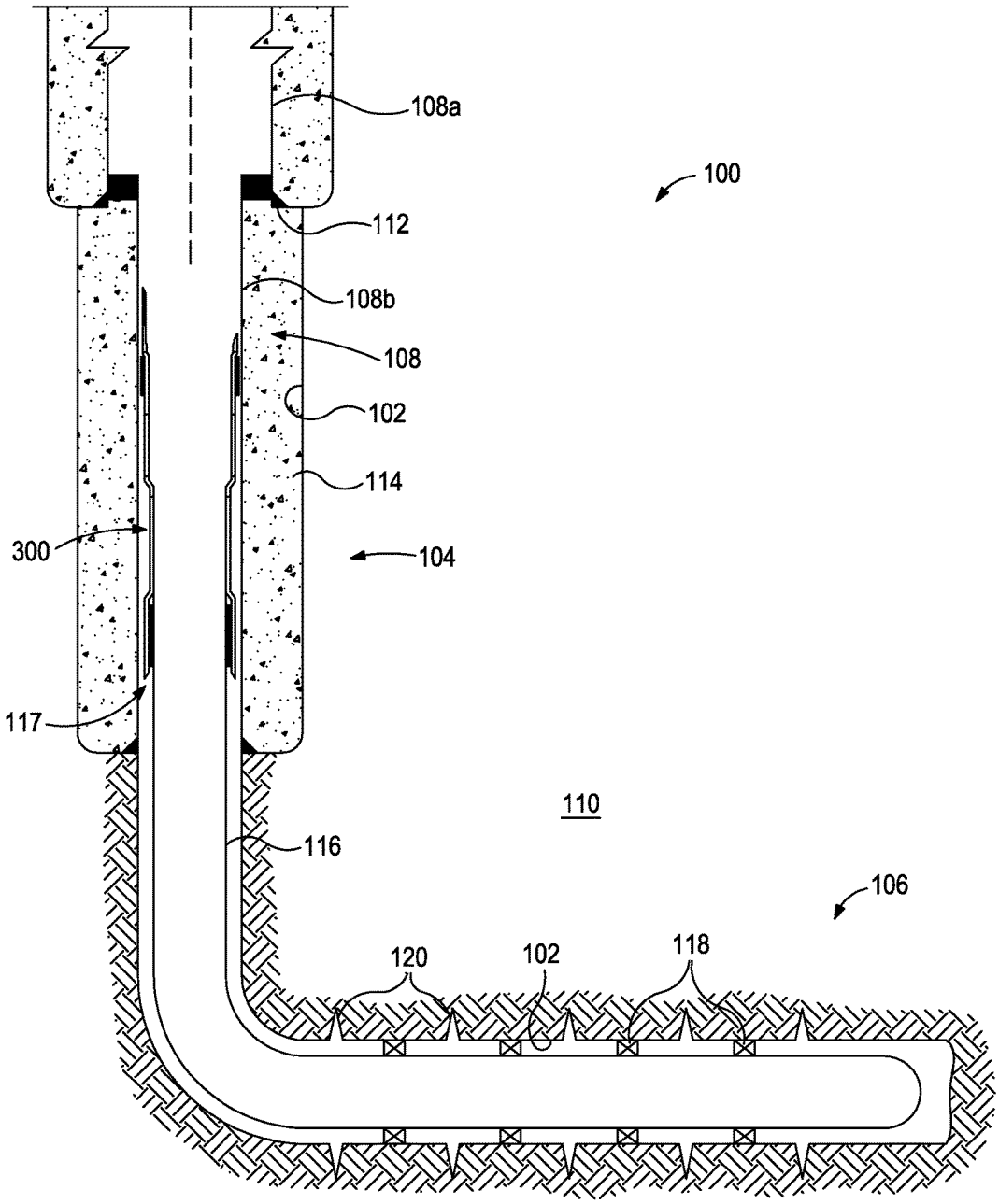
FIGS. 3A and 3B illustrate an exemplary mid-completion assembly positioned on the liner.
Figure 3B:
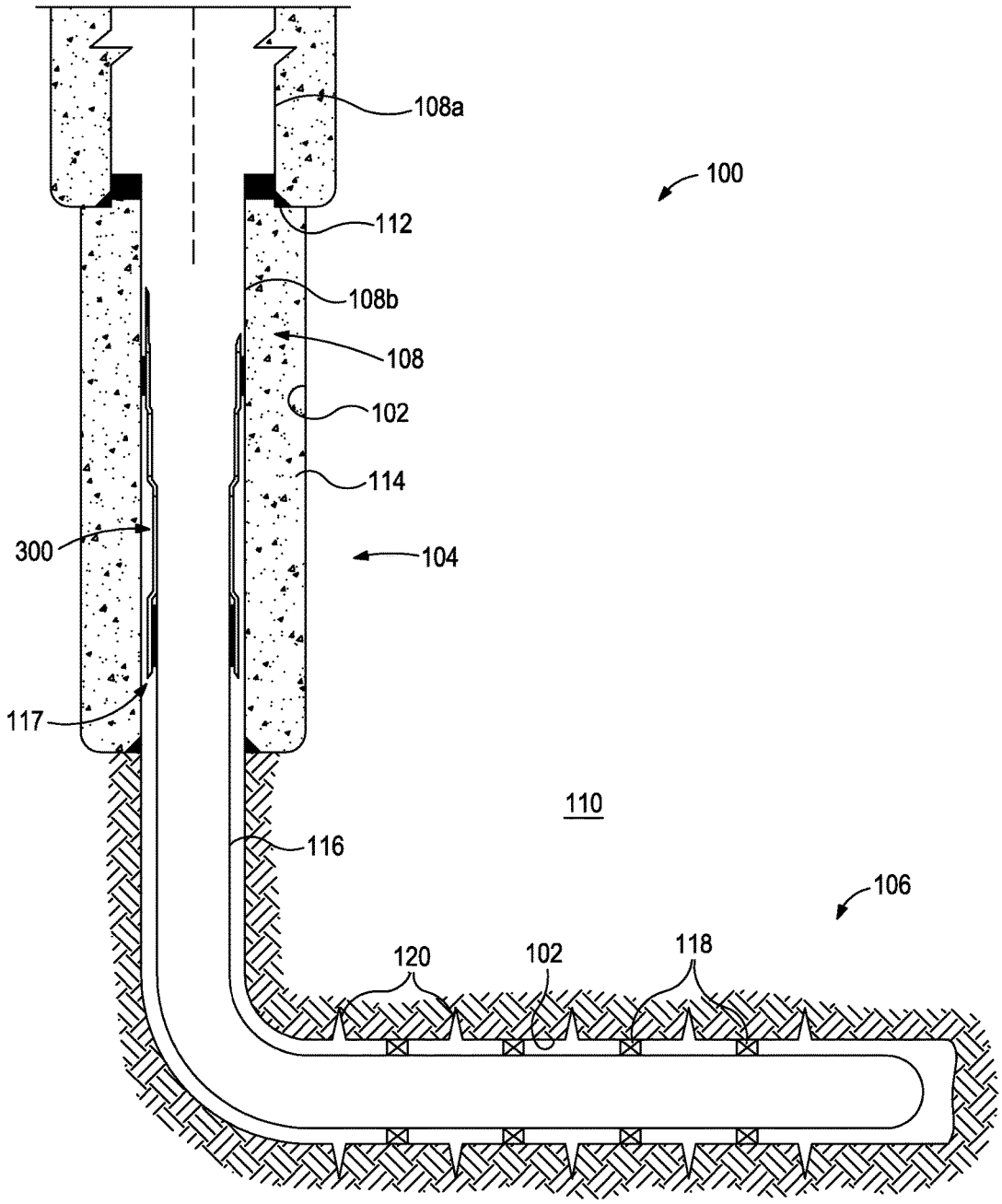

FIGS. 3A and 3B are views of the well system 100 as including a mid-completion assembly 300 sealingly engaged to the exposed end 117 of the liner 116. More specifically, and as described below, FIG. 3A illustrates the mid-completion assembly 300 in a contracted configuration, where the mid-completion assembly 300 is detached from the second string of casing 108*b* and FIG. 3B illustrates the mid-completion assembly 300 in an expanded configuration, where the mid-completion assembly 300 is secured or anchored to the second string of casing 108*b*.

Figure 3C:
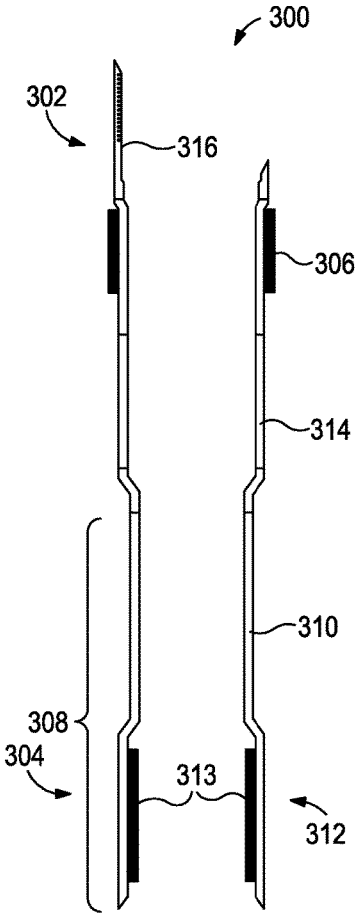
FIG. 3C illustrates the mid-completion assembly of FIGS. 3A and 3B in the contracted configuration.
Figure 3D:
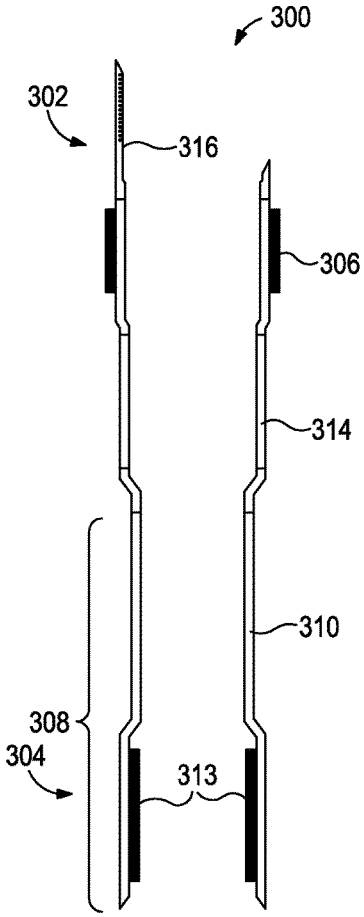
FIG. 3D illustrates the mid-completion assembly of FIGS. 3A and 3B in the expanded configuration.
Figure 3E:
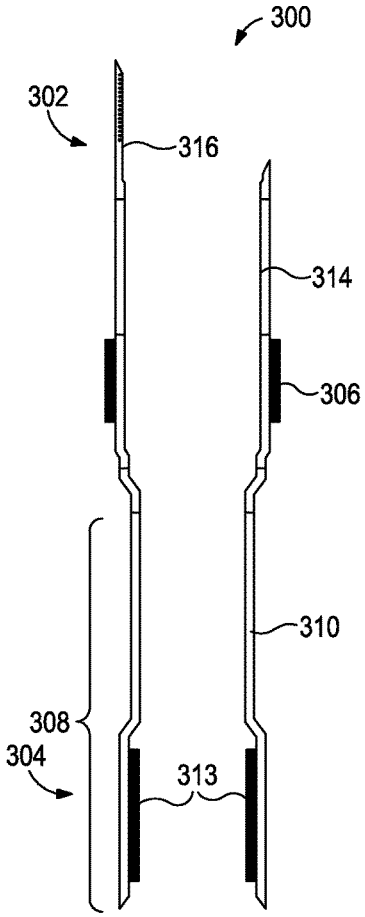
FIG. 3E illustrates another exemplary mid-completion assembly.

FIGS. 3C-3E are cross-sectional side views of exemplary embodiments of the mid-completion assembly 300. As illustrated, the mid-completion assembly 300 is a generally tubular elongated device having a first end 302 and a second end 304 opposite the first end 302. An expandable device 306 may be located at or adjacent the first end 302, and may comprise any device that, under the proper stimuli or mechanical interaction, transitions from a contracted configuration to an expanded configuration. The expandable device 306 may comprise, for example, an expandable wellbore packer or wellbore isolation device. However, the expandable device 306 is not limited thereto, and may otherwise comprise a casing patch, an expandable anchor, an expandable hanger, an expandable liner, or any combination thereof.

The expandable device 306 may be configured to seal against the inner wall of the casing 108 (FIGS. 1, 2, 3A-3B), such as the second string of casing 108*b* (FIG. 1, 2, 3A-3B). It will be understood that, although the mid-completion assembly 300 is described as engaging the second string of casing 108*b*, the mid-completion assembly 300 may also engage the first string of casing 108*a* when a lateral wellbore is to be drilled at a location along the first string of casing 108*a* (FIGS. 1, 2, 3A-3B).

In the contracted configuration, the expandable device 306 may have a diameter smaller than the second string of casing 108*b*. The mid-completion assembly 300 may be conveyed downhole in the contracted configuration illustrated in FIGS. 3A and 3C. Once the mid-completion assembly 300 is installed on the cut end 117 of the liner 116, a radial expansion force (e.g., mechanical, hydraulic, etc.) is applied to drive the expandable device 306 to the expanded configuration illustrated in FIGS. 3B, 3D, and 3E, wherein the expandable device 306 sealingly engages the inner wall of the second string of casing 108*b*. Once the expandable device 306 has been engaged or set in the second string of casing 108*b*, the mid-completion assembly 300 is secured (or anchored) within the second string of casing 108*b*. When secured, the expandable device 306 may prevent fluids (e.g., hydraulic fluids, wellbore fluids, gases, etc.) from migrating across the expandable device 306 in either direction, and the expansion force may resist torsional and/or axial movement of the mid-completion assembly 300. Alternatively or additionally, one or more expandable slips (not expressly illustrated) may be located on the outer surface of the mid-completion assembly 300 to grip the second string of casing 108*b* to resist torsional and/or axial movement of the mid-completion assembly 300. When the radial expansion force is released, the expandable device 306 may be configured to return to the contracted configuration illustrated in FIGS. 3A and 3C. The mid-completion assembly 300 may then be dislodged from the liner 116, if desired. Alternatively, the expandable device 306 is milled out from the mid-completion assembly 300 to dislodge the mid-completion assembly 300 from the liner 116.

A tail pipe assembly 308 may be located at or adjacent the second end 304 of the mid-completion assembly 300. The tail pipe assembly 308 may include an elongate tail pipe 310 and a sealing assembly 312 disposed at the lower end of the tail pipe 310. The sealing assembly 312 may be or include one or more sealing elements 313 disposed on the inner surface of the tail pipe 310. In securing the mid-completion assembly 300 to the liner 116 (FIGS. 2, 3A and 3B), the cut end 117 of the liner 116 may be received within the tail pipe 310 and the sealing elements 313 may be configured to sealingly engage the outer surface of the liner 116. The sealing elements 313 provide a seal such that fluids (e.g., hydraulic fluids, wellbore fluids, gases, etc.) are unable to migrate across the sealing elements 313 in either direction. The sealing elements 313 may be made of a variety of materials including, but not limited to, an elastomeric material, a metal, a composite, a rubber, a ceramic, any derivative thereof, and any combination thereof. In any example, the sealing elements 313 may comprise one or more O-rings or the like. In any example, however, the sealing elements 313 may comprise a set of v-rings or CHEVRON® packing rings, or another appropriate seal configuration (e.g., seals that are round, v-shaped, u-shaped, square, oval, t-shaped, rectangular with rounded corners, D-shaped profile, etc.), as generally known to those skilled in the art.

The mid-completion assembly 300 may also include an orientation device 316 disposed at the upper end of the expandable device 306. The orientation device 316 may ensure correct angular and axial orientation of a downhole tool that may be installed in and otherwise received by the mid-completion assembly 300. In any example, the orientation device 316 may define a tapering (or a uniquely profiled or patterned) surface to azimuthally orient the downhole tool during installation. Alternatively, the orientation device 316 may include a latch coupling having a unique profile pattern that is operable to selectively mate with a corresponding latch profile of the downhole tool such that the downhole tool may be rotationally and axially oriented in orientation device 316. It should be noted that although FIGS. 3C-3E illustrate the orientation device 316 disposed at the upper end of the expandable device 306, the orientation device 316 may alternatively be disposed at the lower end of the expandable device 306 or any other desired location in the mid-completion assembly 300, without departing from the scope of the disclosure.

The mid-completion assembly 300 may also include a receptacle 314. In FIGS. 3C and 3D, the receptacle 314 interposes the expandable device 306 and the tail pipe assembly 308. In FIG. 3E, however, the receptacle 314 interposes the orientation device 316 and the expandable device 306. In any example, the receptacle 314 may be or otherwise include a polished bore receptacle (PBR) or any other desired receptacle having a profile or surface configured to engage one or more downhole components, as described below. It will thus be understood that the placement of the various components of the mid-completion assembly 300 can be varied as required by design and/or application, without departing from the scope of the disclosure.

It should be noted that each of the component parts of the mid-completion assembly 300 have an inner diameter that permits existing wellbore equipment and/or wellbore equipment that was previously used for operations in the main wellbore 102 (FIG. 1) to still be able to access the main wellbore 102 without having to retrieve the mid-completion assembly 300 to the earth's surface. In some examples, the inner diameter of each component part of the mid-completion assembly 300 may be the same as the inner diameter of the liner 116. In other examples, the inner diameter of each component part of the mid-completion assembly 300 may be less than the inner diameter of the liner 116. In still other examples, the inner diameter of each component part of the mid-completion assembly 300 may be greater than the inner diameter of the liner 116. In yet other examples, one or more component parts of the mid-completion assembly 300 may have an inner diameter less than the inner diameter of the liner 116, while one or more other component parts of the mid-completion assembly 300 may have an inner diameter greater than the inner diameter of the liner 116.

It will thus be understood that the component parts of the mid-completion assembly 300 can have a desired inner diameter as long as the smallest inner diameter of any of the component parts of the mid-completion assembly 300 permits existing wellbore equipment and/or wellbore equipment that was previously used for operations in the main wellbore 102 (FIG. 1) to still be able to access portion(s) of the liner 116 (or, alternatively, portion(s) of the main wellbore 102) having the smallest inner diameter without having to retrieve the mid-completion assembly 300 to the earth's surface.

Figure 4:
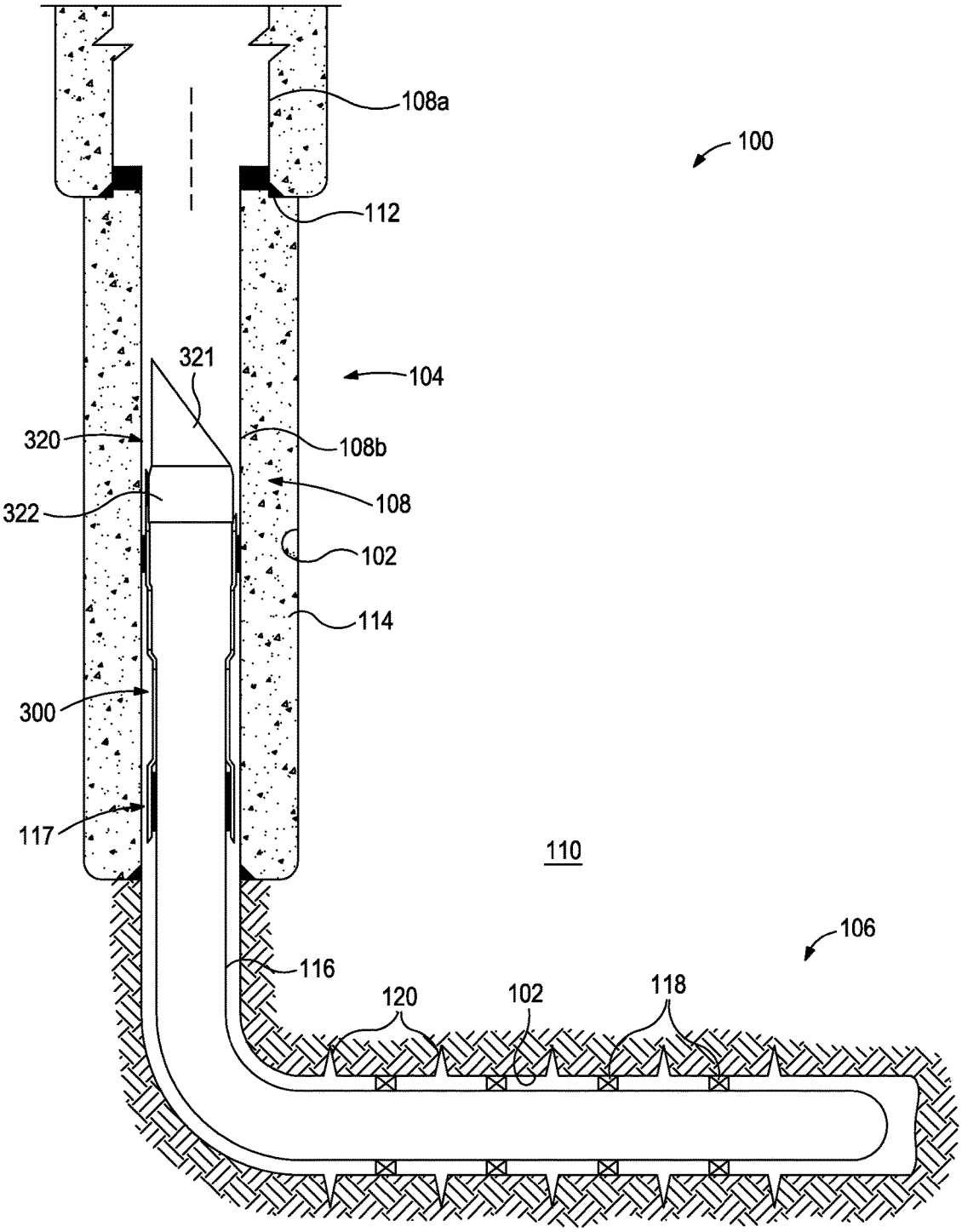
FIG. 4 illustrates a deflector tool installed in the mid-completion assembly of FIGS. 3A and 3B.

FIG. 4 illustrates an exemplary deflector tool 320 received by and otherwise installed in the mid-completion assembly 300. The deflector tool 320 may comprise a whipstock device 321 used for deflecting a cutting tool (e.g., a mill, a drill bit, etc.) to drill a lateral wellbore that extends from the main wellbore 102. In any example, the deflector tool 320 may comprise a combination whipstock/deflector capable of performing both the operations of a whipstock device and a completion deflector in a single run into the second string of casing 108*b*.

The deflector tool 320 may include a locating device 322 positioned at or adjacent the lower end thereof. The locating device 322 may be used to locate and engage the orientation device 316 (FIGS. 3C-3E) to ensure correct axial and angular orientation of the deflector tool 320 when installed in the mid-completion assembly 300. For instance, the locating device 322 may be or include a latch assembly including latch keys that operably engage a corresponding latch profile provided by the orientation device 316.

Figure 5A:
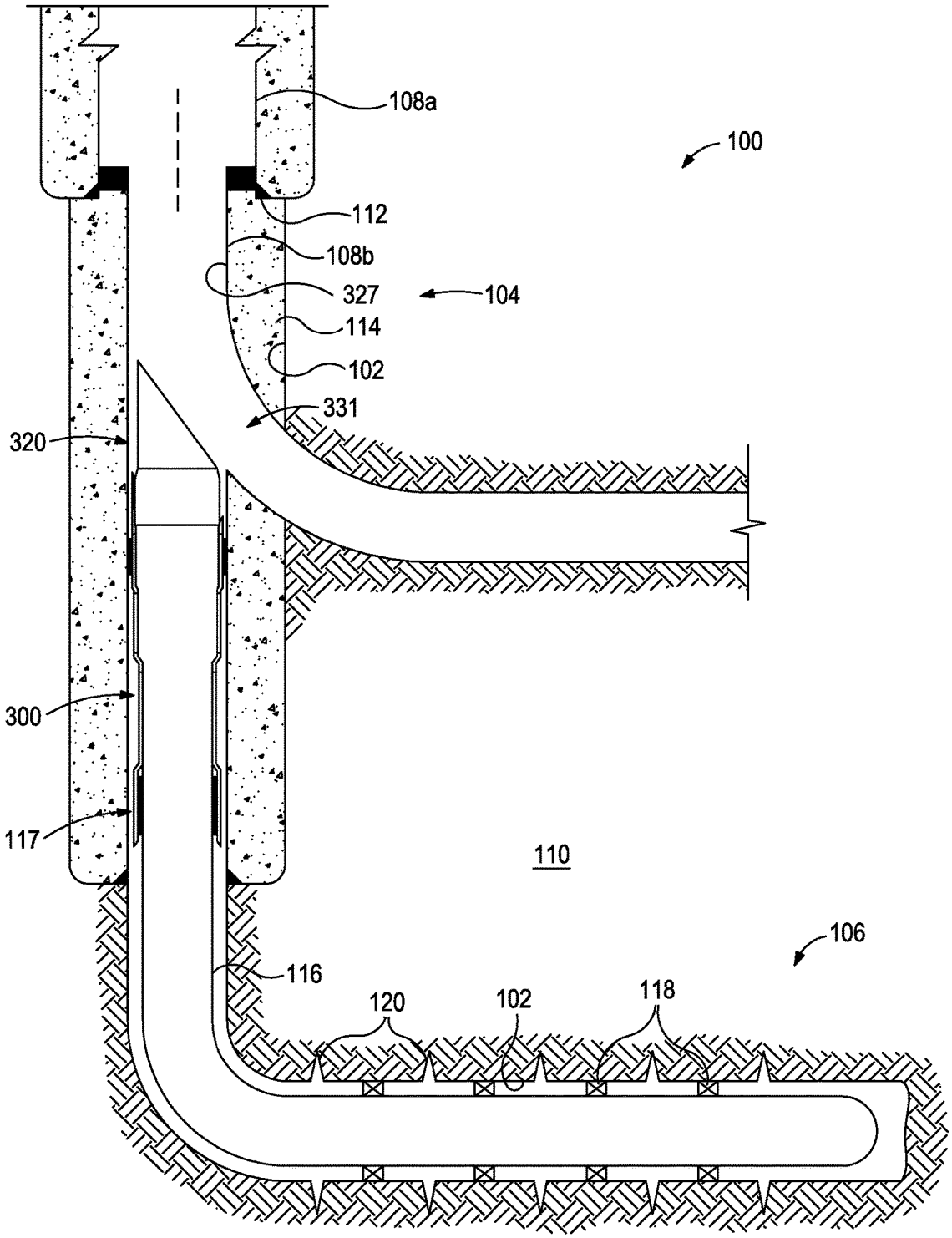
FIG. 5A illustrates a lateral wellbore that is drilled extending from the wellbore in FIG. 1.

FIG. 5A illustrates a lateral wellbore 326 that is drilled and extends from the main wellbore 102. To drill the lateral wellbore 326, one or more mills (not illustrated) may be deflected off the whipstock 321 and into engagement with the second string of casing 108*b* to mill a casing exit 327 (alternately referred to as a "window") in the second string of casing 108*b*. A drill bit (not illustrated) can be subsequently deflected through the casing exit 327 to drill the lateral wellbore 326 into the formation 110 to a desired extent and orientation. A junction 331 is thereby provided at the intersection of the lateral wellbore 326 and the main wellbore 102.

Figure 5B:
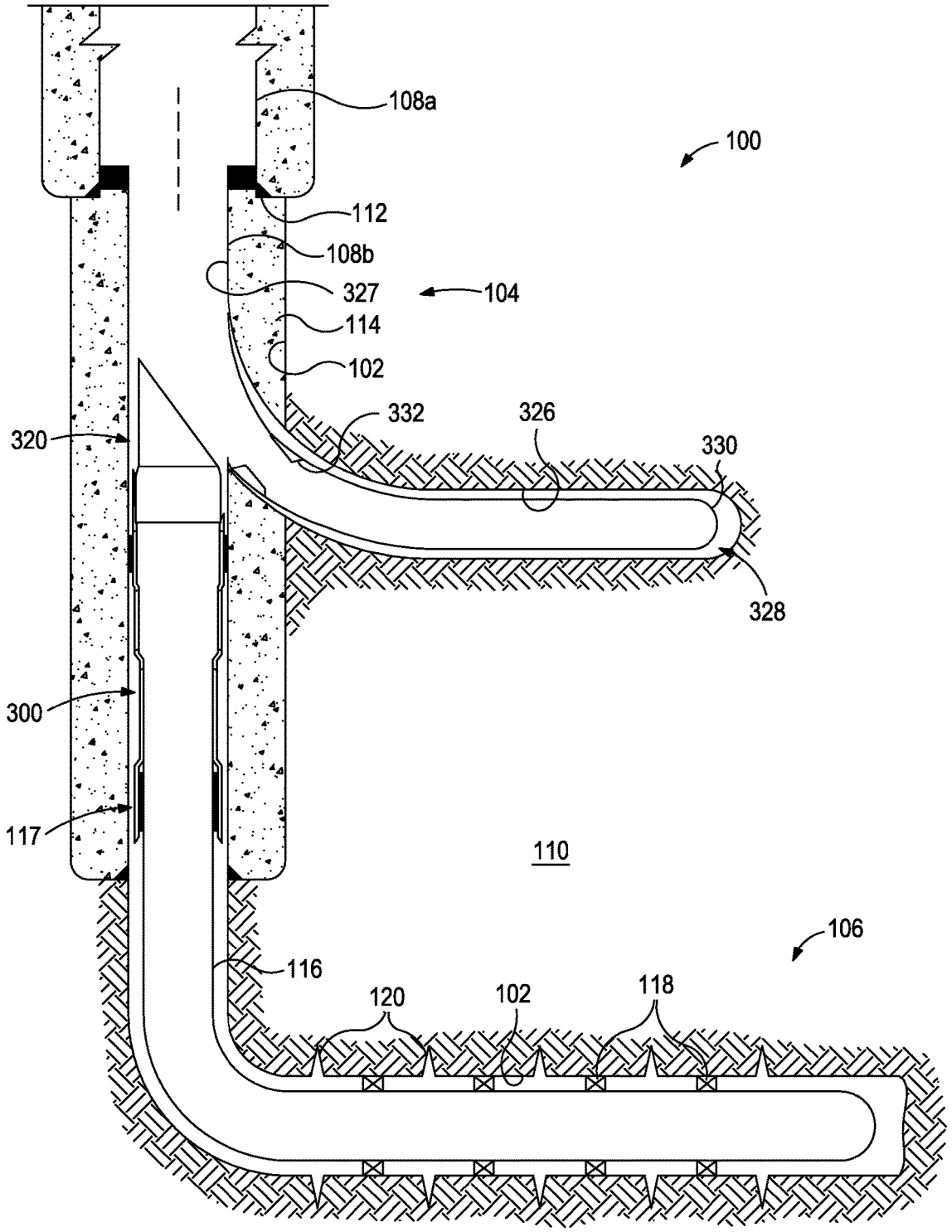
FIG. 5B illustrates a completion assembly extended into the lateral wellbore of FIG. 5A.

As illustrated in FIG. 5B, a completion assembly 328 may be extended into the lateral wellbore 326 in order to produce hydrocarbons from the formation 110 penetrated by the lateral wellbore 326. The completion assembly 328 includes a completion liner 330 that extends into the lateral wellbore 326. A plurality of packers or other wellbore isolation devices (not illustrated) may be used to isolate axially adjacent production zones in the lateral wellbore 326. More particularly, the wellbore isolation devices seal against the inner wall of the lateral wellbore 326 and thereby provide fluid isolation between axially adjacent production zones. Each production zone may further include a sliding sleeve (not illustrated) positioned within the completion liner 330 and axially movable between closed and open positions to occlude or expose one or more flow ports (not illustrated) defined through the completion liner 330. A receptacle 332 (e.g., a PBR or a similar receptacle) may be coupled to the inner surface of the completion liner 330 at or adjacent the junction 331 between the main wellbore 102 and the lateral wellbore 326.

Figure 5C:
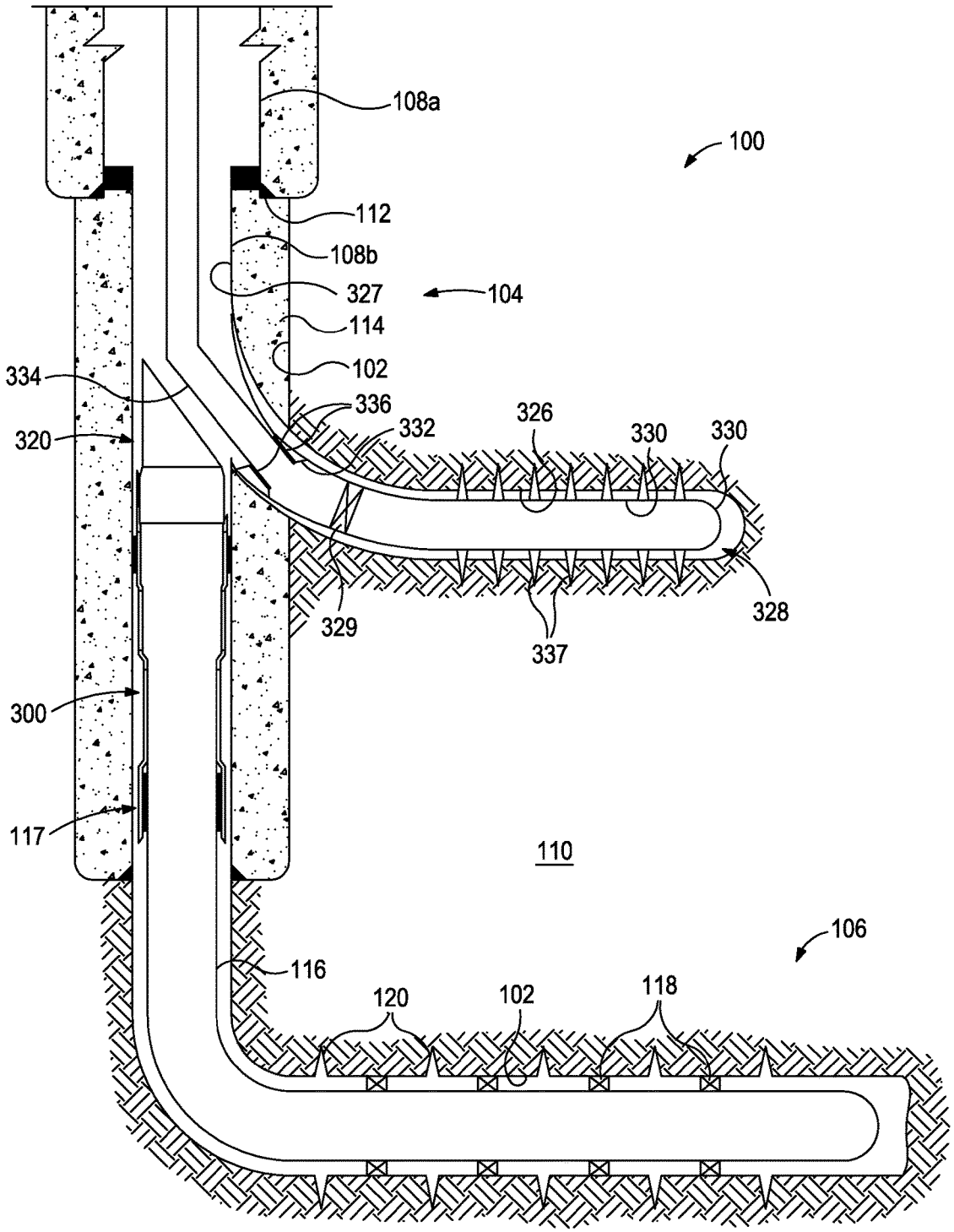
FIG. 5C illustrates a first tubular conveyed into the lateral wellbore of FIG. 5A.

As illustrated in FIG. 5C, a first tubular 334, such as a frac string or similar, may be conveyed downhole and deflected into the lateral wellbore 326 using the deflector tool 320. The first tubular 334 may be received in the receptacle 332 and may be sealingly coupled thereto via sealing elements 336 included on the outer surface of the first tubular 334. At its uphole end, the first tubular 334 may either be coupled to the wellhead on the surface or may be coupled to another tubular (casing string or liner) positioned uphole in the main wellbore 102. With the first tubular 334 positioned in sealed engagement with the completion liner 330, the main wellbore 102 is isolated from any operations performed in the lateral wellbore 326.

The formation 110 surrounding the lateral wellbore 326 may then be hydraulically fractured (e.g., plug-and-perf operations, dissolvable plug-and-perf operations, continuous stimulation operations, and the like, and any combination thereof) to generate perforations or fractures 337 that extend radially outward from the lateral wellbore 326. The fractures 337 provide fluid communication between the formation 110 and the interior of the completion liner 330. Hydrocarbons and other wellbore fluids can then be produced from the lateral wellbore 326. Depending on the pressure in the formation 110 penetrated by the lateral wellbore 326, a plug or barrier 329 (e.g., mechanical, hydraulic, or the like) may be run into the lateral wellbore 326 through the first tubular 334 and positioned in the lateral wellbore 326 to seal or plug the lateral wellbore 326. For instance, if the pressure is relatively low, the plug 329 may not be required. Alternatively, if the pressure in the formation 110 is high, the plug 329 may be used to isolate the lateral wellbore 326 from the main wellbore 102.

Figure 6A:
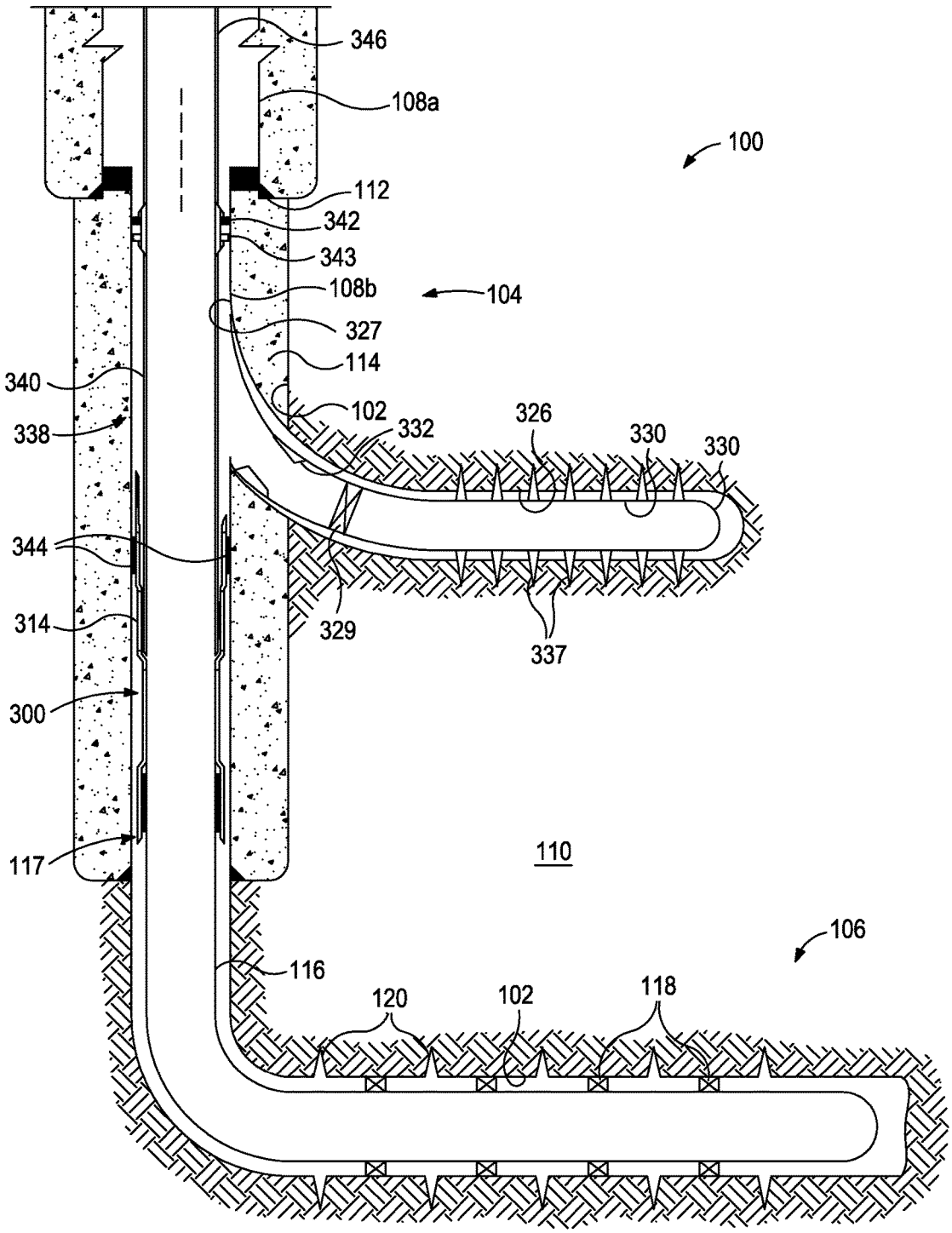
FIG. 6A illustrates an isolation assembly installed in the mid-completion assembly of FIGS. 3A and 3B

When it is required to re-access the main wellbore 102, the first tubular 334 may be pulled out of the lateral wellbore 326 and retrieved to the surface. The deflector tool 320 may also be removed from the mid-completion assembly 300 and retrieved to the surface. As illustrated in FIG. 6A, with the mid-completion assembly 300 secured to the second string of casing 108*b*, an isolation assembly 338 may be extended into and otherwise installed in the mid-completion assembly 300. The isolation assembly 338 may be used to isolate the lateral wellbore 326 while performing wellbore operations in the main wellbore 102. In any example, the wellbore operations may include re-fracturing or re-stimulating portions of the main wellbore 102.

As illustrated, the isolation assembly 338 may include a spacer pipe 340 having a wellbore isolation device 342 and an anchoring device 343 at or adjacent the uphole end thereof and one or more sealing elements 344 at or adjacent the downhole end thereof. The axial extent of the spacer pipe 340 is such that the wellbore isolation device 342, when set, engages the second string of casing 108*b* uphole from the junction 331. The downhole end of the spacer pipe 340 may be received within the mid-completion assembly 300 such that the sealing element(s) 344 sealingly engage the receptacle 314 of the mid-completion assembly 300 and provide a seal such that fluids (e.g., hydraulic fluids, wellbore fluids, gases, etc.) are unable to migrate across the sealing elements 344 in either direction. The wellbore isolation device 342 and the sealing elements 344 may be similar to the expandable device 306 (FIGS. 3C-3E) and the sealing elements 312 (FIGS. 3C-3E), respectively, as described above and, therefore, will not be described in detail.

The isolation assembly 338 is installed in the mid-completion assembly 300 by receiving and sealingly engaging the sealing elements 344 within the receptacle 314. The wellbore isolation device 342 may then be actuated to sealingly engage the inner surface of the second string of casing 108*b*. The anchoring device 343 may also be actuated to grip the inner surface of the second string of casing 108*b* to resist torsional and/or axial movement of the isolation assembly 338. When installed, the isolation assembly 338 isolates the lateral wellbore 326 from the main wellbore 102, thereby minimizing any effect of any operations performed in the main wellbore 102 on the lateral wellbore 326.

In any example, a second tubular 346 (e.g., a frac string, production tubing, or a liner) may be coupled to and extend from the isolation assembly 338. At its axially opposite end, the second tubular 346 may either be coupled to the wellhead on the surface or may be coupled to another tubular (casing string or liner) positioned uphole in the main wellbore 102. However, in any example, the second tubular 346 may be omitted.

Although FIG. 6A illustrates the mid-completion assembly 300 of FIGS. 3A-3D, the mid-completion assembly 300 of FIG. 3E or a mid-completion assembly of any desired configuration can also be used in FIG. 6A, without departing from the scope of the disclosure. It will also be understood that, although examples above describe the isolation assembly 338 being installed in the main wellbore 102, the isolation assembly 338 may alternatively be installed in the lateral wellbore 326 (or a separate "branch" extending from the lateral wellbore 326) in place of the first tubular 334 (FIG. 5C), without departing from the scope of the disclosure. For instance, when installed in the lateral wellbore 326, the sealing elements 344 of the isolation assembly 338 may engage the receptacle 332 in the lateral wellbore 326 and the wellbore isolation device 342 may sealing engage the inner surface of the second string of casing 108*b* uphole from the junction 331. The second tubular 346 may be coupled to and extend from the isolation assembly 338.

Figure 6B:
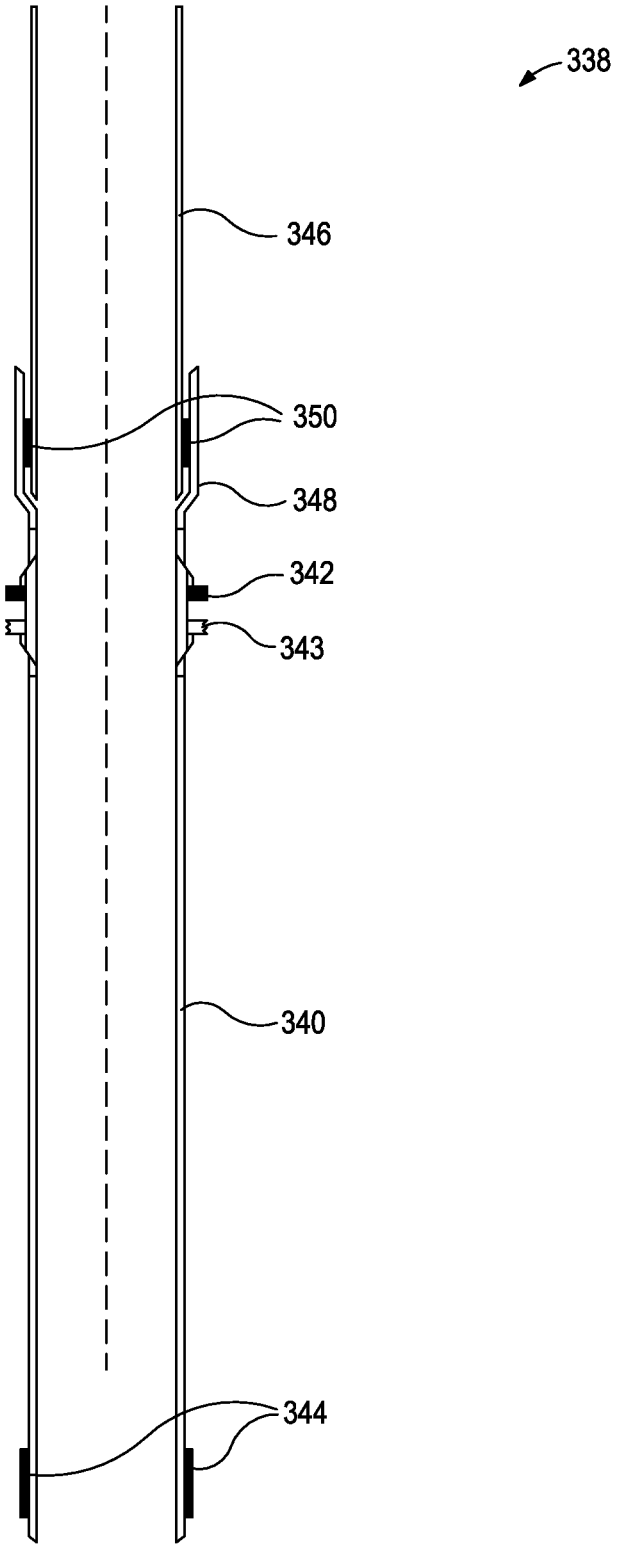
FIG. 6B illustrates a second tubular coupled to the isolation assembly of FIG. 6A via a receptacle.

FIG. 6B depicts another example of the isolation assembly 338 of FIG. 6A. As illustrated, the second tubular 346 may be coupled to the isolation assembly 338 via a receptacle 348 included in the isolation assembly 338. For instance, the receptacle 348 may be or include a polished bore receptacle or any other receptacle that provides a surface or profile configured to receive and one or more sealing elements 350 of the second tubular 346 to sealingly engage the receptacle 348. For the sake of clarity, FIG. 6B illustrates the isolation assembly 338, the second tubular 346, and the receptacle 348 and omits the other components illustrated in FIG. 6A.

Referring to FIGS. 6A and 6B, it should be noted that the spacer pipe 340, the second tubular 346, and the receptacle 348 have an inner diameter that permits existing wellbore equipment and/or wellbore equipment that was previously used for operations in the main wellbore 102 to still be able to access the main wellbore 102 without having to retrieve the mid-completion assembly 300 to the earth's surface. In an example, the inner diameter of the spacer pipe 340, the second tubular 346, and the receptacle 348 may be the same as the inner diameter of the liner 116. Alternatively, the inner diameter of each of the spacer pipe 340, the second tubular 346, and the receptacle 348 may be less than the inner diameter of the liner 116, or, in other cases, may be greater than the inner diameter of the liner 116. In one or more other examples, one or more of the spacer pipe 340, the second tubular 346, and the receptacle 348 may have an inner diameter less than the inner diameter of the liner 116, while the other(s) may have an inner diameter that greater than the inner diameter of the liner 116.

Thus, the spacer pipe 340, the second tubular 346, and the receptacle 348 can have a desired inner diameter as long as the smallest inner diameter of any of the spacer pipe 340, the second tubular 346, and the receptacle 348 permits existing wellbore equipment and/or wellbore equipment that was previously used for operations in the main wellbore 102 (FIG. 1) to still be able to access portion(s) of the liner 116 (or, alternatively, of the main wellbore 102) having the smallest inner diameter without having to retrieve the mid-completion assembly 300 to the earth's surface.

It will be appreciated that having the smallest inner diameters of the above referenced components of each of the mid-completion assembly 300 and the isolation assembly 338 that permit existing wellbore equipment and/or wellbore equipment to still be able to access portion(s) of the liner 116 (or, alternatively, the main wellbore 102) having the smallest inner diameter ensures that each of the mid-completion assembly 300 and the isolation assembly 338, individually and in combination (as illustrated in FIG. 6A, wherein the isolation assembly 338 is installed in the mid-completion assembly 300), permits existing wellbore equipment and/or wellbore equipment that was previously used for operations in the liner 116 (or the main wellbore 102) to still be able to access portion(s) of the liner 116 (or, alternatively, the main wellbore 102) having the smallest inner diameter without having to retrieve the mid-completion assembly 300 and/or the isolation assembly 338 to the earth's surface.

Embodiments disclosed herein include:

A. A method including severing a liner positioned in a first wellbore at least partially lined with casing and thereby providing a severed end, conveying a mid-completion assembly into the first wellbore and receiving the severed end within a tail pipe assembly of the mid-completion assembly, wherein a smallest inner diameter of the mid-completion assembly is greater than or equal to a smallest inner diameter of the liner and thereby permits tools sized for operations in the liner to pass through the mid-completion assembly, actuating an expandable device of the mid-completion assembly to sealingly engage an inner surface of the casing uphole from the severed end, and drilling a second wellbore extending from the first wellbore.

B. A system that includes a first wellbore drilled through a formation and at least partially lined with casing, a second wellbore extending from the first wellbore, a liner positioned in the first wellbore and severed at a desired location and thereby providing a severed end, and a mid-completion assembly including an expandable device that sealingly engages an inner surface of the casing uphole from the severed end and a tail pipe assembly that engages an outer surface of the severed end, wherein a smallest inner diameter of the mid-completion assembly is greater than or equal to a smallest inner diameter of the liner.

Each of embodiments A and B may have one or more of the following additional elements in any combination: Element 1: wherein receiving the severed end within the tail pipe assembly comprises engaging sealing elements disposed on an inner surface of the tail pipe assembly with an outer surface of the severed end.

Element 2: wherein the mid-completion assembly further includes an orientation device, the method further comprising conveying a deflector tool into the first wellbore, angularly orienting the deflector tool within the first wellbore using the orientation device, securing the deflector tool to the mid-completion assembly, and drilling the second wellbore using the deflector tool. Element 3: wherein the liner is a first liner and the method further comprises installing a completion liner in the second wellbore and coupling a second liner to the completion liner by engaging one or more sealing elements of the second liner with a receptacle of the completion liner. Element 4: wherein the one or more sealing elements are first sealing elements and the mid-completion assembly further includes a receptacle, the method further comprising detaching the second liner from the completion liner and retrieving the second liner to the earth's surface, detaching the deflector tool from the mid-completion assembly and retrieving the deflector tool to the earth's surface, conveying an isolation assembly into the first wellbore and receiving the isolation assembly within the receptacle, wherein a smallest inner diameter of the isolation assembly is greater than or equal to the smallest inner diameter of the first liner, coupling the isolation assembly with the mid-completion assembly by sealingly engaging second sealing elements positioned on an outer surface of the isolation assembly with the receptacle, and actuating a wellbore isolation device of the isolation assembly to sealingly engage an inner surface of the casing uphole from a junction of the first and second wellbores. Element 5: further comprising installing a completion liner in the second wellbore, and coupling an isolation assembly to the completion liner by engaging one or more sealing elements of the isolation assembly with a receptacle of the completion liner. Element 6: wherein the one or more sealing elements are first sealing elements, the isolation assembly is a first isolation assembly and the mid-completion assembly further includes a receptacle, the method further comprising detaching the first isolation assembly from the completion liner and retrieving the first isolation assembly to the earth's surface, detaching the deflector tool from the mid-completion assembly and retrieving the deflector tool to the earth's surface, conveying a second isolation assembly into the first wellbore and receiving the second isolation assembly within the receptacle, wherein a smallest inner diameter of the isolation assembly is greater than or equal to the smallest inner diameter of the liner, coupling the second isolation assembly with the mid-completion assembly by sealingly engaging second sealing elements positioned on an outer surface of the second isolation assembly with the receptacle, and actuating a wellbore isolation device of the second isolation assembly to sealingly engage an inner surface of the casing uphole from a junction of the first and second wellbores. Element 7: wherein the mid-completion assembly further includes a receptacle, the method further comprises conveying an isolation assembly into the first wellbore, receiving the isolation assembly within the receptacle, wherein a smallest inner diameter of the isolation assembly is greater than or equal to the smallest inner diameter of the liner, sealingly engaging the receptacle with one or more sealing elements positioned on an outer surface of the isolation assembly, and actuating a wellbore isolation device of the isolation assembly to sealingly engage an inner surface of the casing uphole from a junction of the first and second wellbores. Element 8: wherein the one or more sealing elements are first sealing elements and the method further comprises conveying a tubular into the first wellbore, and coupling the tubular to the isolation assembly by engaging second sealing elements positioned on an outer surface of the tubular with a receptacle of the isolation assembly. Element 9: further comprising conveying one or more tools through the mid-completion assembly and into portions of the first wellbore downhole from the mid-completion assembly, and performing one or more wellbore operations in the portions of the first wellbore downhole from the mid-completion assembly. Element 10: further comprising, polishing the severed end prior to receiving the severed end within the tail pipe assembly.

Element 11: wherein the tail pipe assembly comprises sealing elements on an inner surface thereof that engage with the outer surface of the severed end. Element 12: wherein the mid-completion assembly further includes an orientation device that angularly orients a deflector tool installed in the mid-completion assembly for drilling the second wellbore. Element 13: wherein the liner is a first liner and the system further comprises a completion liner installed in the second wellbore and including a receptacle, and a second liner coupled to the completion liner by engaging sealing elements of the second liner with the receptacle. Element 14: further comprising an isolation assembly received within a receptacle of the mid-completion assembly and having a smallest inner diameter greater than or equal to the smallest inner diameter of the liner, wherein the isolation assembly includes: one or more sealing elements on an outer surface thereof and sealingly engaging the receptacle, and a wellbore isolation device that sealingly engages an inner surface of the casing uphole from a junction of the first and second wellbores. Element 15: wherein the one or more sealing elements are first sealing elements and the isolation assembly includes a receptacle, and the system further comprises a tubular having second sealing elements on an outer surface thereof and sealingly engaging the receptacle. Element 16: wherein the mid-completion assembly further includes an orientation device for angularly orienting a downhole tool installed in the mid-completion assembly and wherein the expandable device interposes the orientation device and the receptacle. Element 17: wherein the mid-completion assembly further includes an orientation device for angularly orienting a downhole tool installed in the mid-completion assembly and wherein the receptacle interposes the expandable device and the orientation device. Element 18: wherein the mid-completion assembly permits one or more downhole tools to pass therethrough into portions of the first wellbore downhole from the mid-completion assembly for performing one or more wellbore operations therein.

By way of non-limiting example, exemplary combinations applicable to A and B include: Element 2 with Element 3; Element 3 with Element 4; Element 2 with Element 5; Element 5 with Element 6; Element 7 with Element 8; Element 12 with Element 13; Element 14 with Element 15; Element 14 with Element 16; and Element 14 with Element 17.

Therefore, the disclosed systems and methods are well adapted to attain the ends and advantages mentioned as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

severing a liner positioned in a first wellbore at least partially lined with casing and thereby providing a severed end;

conveying a mid-completion assembly into the first wellbore and receiving the severed end within a tail pipe assembly of the mid-completion assembly, wherein a smallest inner diameter of the mid-completion assembly is greater than or equal to a smallest inner diameter of the liner and thereby permits tools sized for operations in the liner to pass through the mid-completion assembly;

expanding an expandable device of the mid-completion assembly to sealingly engage an inner surface of the casing uphole from the severed end; and drilling a second wellbore extending from the first wellbore.

2. The method of claim 1, wherein receiving the severed end within the tail pipe assembly comprises engaging sealing elements disposed on an inner surface of the tail pipe assembly with an outer surface of the severed end.

3. The method of claim 1, wherein the mid-completion assembly further includes an orientation device and the method further comprises:

conveying a deflector tool into the first wellbore;

angularly orienting the deflector tool within the first wellbore using the orientation device;

securing the deflector tool to the mid-completion assembly; and drilling the second wellbore using the deflector tool.

4. The method of claim 3, wherein the liner is a first liner and the method further comprises:

installing a completion liner in the second wellbore; and coupling an isolation assembly to the completion liner by engaging one or more sealing elements of the isolation assembly with a receptacle of the completion liner.

5. The method of claim 4, wherein the one or more sealing elements are first sealing elements and the mid-completion assembly further includes a receptacle, the method further comprising:

detaching the deflector tool from the mid-completion assembly and retrieving the deflector tool to the earth's surface;

coupling the isolation assembly with the mid-completion assembly by sealingly engaging second sealing elements positioned on an outer surface of the isolation assembly with the receptacle; and actuating a wellbore isolation device of the isolation assembly to sealingly engage an inner surface of the casing uphole from a junction of the first and second wellbores.

6. The method of claim 4, wherein the one or more sealing elements are first sealing elements, the isolation assembly is a first isolation assembly and the mid-completion assembly further includes a receptacle, the method further comprising:

detaching the first isolation assembly from the completion liner and retrieving the first isolation assembly to the earth's surface;

detaching the deflector tool from the mid-completion assembly and retrieving the deflector tool to the earth's surface;

conveying a second isolation assembly into the first wellbore and receiving the second isolation assembly within the receptacle, wherein a smallest inner diameter of the isolation assembly is greater than or equal to the smallest inner diameter of the liner;

coupling the second isolation assembly with the mid-completion assembly by sealingly engaging second sealing elements positioned on an outer surface of the second isolation assembly with the receptacle; and actuating a wellbore isolation device of the second isolation assembly to sealingly engage an inner surface of the casing uphole from a junction of the first and second wellbores.

7. The method of claim 1, wherein the mid-completion assembly further includes a receptacle and the method further comprises:

conveying an isolation assembly into the first wellbore;

receiving the isolation assembly within the receptacle, wherein a smallest inner diameter of the isolation assembly is greater than or equal to the smallest inner diameter of the liner;

sealingly engaging the receptacle with one or more sealing elements positioned on an outer surface of the isolation assembly; and actuating a wellbore isolation device of the isolation assembly to sealingly engage an inner surface of the casing uphole from a junction of the first and second wellbores.

8. The method of claim 7, wherein the one or more sealing elements are first sealing elements and the method further comprises:

conveying a tubular into the first wellbore; and coupling the tubular to the isolation assembly by engaging second sealing elements positioned on an outer surface of the tubular with a receptacle of the isolation assembly.

9. The method of claim 1, further comprising:

conveying one or more tools through the mid-completion assembly and into portions of the first wellbore downhole from the mid-completion assembly; and performing one or more wellbore operations in the portions of the first wellbore downhole from the mid-completion assembly.

10. A system, comprising:

a first wellbore drilled through a formation and at least partially lined with casing;

a second wellbore extending from the first wellbore;

a liner positioned in the first wellbore and severed at a desired location and thereby providing a severed end; and a mid-completion assembly including an expandable device that sealingly engages an inner surface of the casing uphole from the severed end and a tail pipe assembly that engages an outer surface of the severed end, wherein a smallest inner diameter of the mid-completion assembly is greater than or equal to a smallest inner diameter of the liner.

11. The system of claim 10, wherein the tail pipe assembly comprises sealing elements on an inner surface thereof that engage with the outer surface of the severed end.

12. The system of claim 10, wherein the mid-completion assembly further includes an orientation device that angularly orients a deflector tool installed in the mid-completion assembly for drilling the second wellbore.

13. The system of claim 12, wherein the liner is a first liner and the system further comprises:

a completion liner installed in the second wellbore and including a receptacle; and a second liner coupled to the completion liner by engaging sealing elements of the second liner with the receptacle.

14. The system of claim 10, further comprising an isolation assembly received within a receptacle of the mid-completion assembly and having a smallest inner diameter greater than or equal to the smallest inner diameter of the liner, wherein the isolation assembly include one or more sealing elements on an outer surface thereof and sealingly engaging the receptacle; and a wellbore isolation device that sealingly engages an inner surface of the casing uphole from a junction of the first and second wellbores.

15. The system of claim 14, wherein the one or more sealing elements are first sealing elements and the isolation assembly includes a receptacle, and the system further comprises:

a tubular having second sealing elements on an outer surface thereof and sealingly engaging the receptacle.

16. The system of claim 14, wherein the mid-completion assembly further includes an orientation device for angularly orienting a downhole tool installed in the mid-completion assembly and wherein the expandable device interposes the orientation device and the receptacle.

17. The system of claim 14, wherein the mid-completion assembly further includes an orientation device for angularly orienting a downhole tool installed in the mid-completion assembly and wherein the receptacle interposes the expandable device and the orientation device.

18. The system of claim 10, wherein the mid-completion assembly permits one or more downhole tools to pass therethrough into portions of the first wellbore downhole from the mid-completion assembly for performing one or more wellbore operations therein.

* * * * *